US012644444B2

(12) United States Patent
Bosway et al.

(10) Patent No.: US 12,644,444 B2
(45) Date of Patent: Jun. 2, 2026

(54) PORTABLE AIR COMPRESSOR

(71) Applicant: The Noco Company, Glenwillow, OH (US)

(72) Inventors: Matthew Michael Bosway, Queen Creek, AZ (US); James Richard Stanfield, Glendale, AZ (US); Michael Joseph Fellman, New York, NY (US)

(73) Assignee: The Noco Company, Glenwillow, OH (US)

( * ) Notice: Subject to any disclaimer, the term of this patent is extended or adjusted under 35 U.S.C. 154(b) by 0 days.

(21) Appl. No.: 19/027,141

(22) Filed: Jan. 17, 2025

(65) Prior Publication Data

US 2025/0237204 A1 Jul. 24, 2025

Related U.S. Application Data

(60) Provisional application No. 63/623,508, filed on Jan. 22, 2024.

(51) Int. Cl.

| | |
|---|---|
| ***F04B 35/04*** | (2006.01) |
| ***F04B 35/06*** | (2006.01) |
| ***F04B 49/08*** | (2006.01) |
| ***F04B 49/20*** | (2006.01) |
| ***F04B 53/16*** | (2006.01) |

(Continued)

(52) U.S. Cl.

CPC ..... *F04B 35/04* (2013.01); *F04B 35/06* (2013.01); *F04B 49/08* (2013.01); *F04B 49/20* (2013.01); *F04B 53/16* (2013.01); *F04B 37/10* (2013.01); *F04B 37/18* (2013.01)

(58) Field of Classification Search

CPC ..... F04B 35/04; F04B 35/06; F04B 39/121; F04B 49/08; F04B 49/20; F04B 53/16

See application file for complete search history.

(56) References Cited

U.S. PATENT DOCUMENTS

| | | | |
|---|---|---|---|
| 4,776,766 | A | 10/1988 | Brent |
| 5,944,066 | A | 8/1999 | Viard |

(Continued)

FOREIGN PATENT DOCUMENTS

| | | |
|---|---|---|
| JP | 6266415 | 1/2018 |

OTHER PUBLICATIONS

Patent Cooperation Treaty, PCT/US2025/011968, International Search Report and Written Opinion, Mar. 17, 2025.

*Primary Examiner* — Charles G Freay

(74) *Attorney, Agent, or Firm* — Jones Day

(57) ABSTRACT

Systems and methods are provided for a portable air compressor comprising an electric battery, an electric motor, a piston, and an air hose. The electric motor is powered by the electric battery. The piston is coupled to and driven by the electric motor. The piston is configured to compress air within a piston cylinder. The air hose has a first end attachable to an air outlet of the piston cylinder and a second end attachable to an inflatable object. The portable air pump is configured to inflate the inflatable object to a target air pressure. When the target air pressure is below a predetermined pressure threshold, the portable air pump inflates the inflatable object at a first inflation rate. When the target air pressure is above the predetermined pressure threshold, the portable air pump inflates the inflatable object at a second inflation rate greater than the first inflation rate.

10 Claims, 8 Drawing Sheets

(51) Int. Cl.
*F04B 37/10* (2006.01)
*F04B 37/18* (2006.01)

(56) References Cited

U.S. PATENT DOCUMENTS

| | | | | |
|---|---|---|---|---|
| 11,824,383 | B2 | 11/2023 | Miller et al. | |
| 12,494,091 | B2 * | 12/2025 | Knott | G07C 5/008 |
| 2004/0047744 | A1 * | 3/2004 | Burkholder | F04B 41/02 417/234 |
| 2018/0223832 | A1 * | 8/2018 | Ren | F04B 49/20 |
| 2021/0040940 | A1 * | 2/2021 | Zhu | B60S 5/046 |

* cited by examiner

PORTABLE AIR COMPRESSOR

CROSS-REFERENCE TO RELATED APPLICATIONS

This application claims priority to U.S. Provisional Application No. 63/623,508, filed Jan. 22, 2024, which is hereby incorporated by reference in its entirety.

FIELD

The present disclosure relates to air compressors, and in particular to a portable air compressor.

BACKGROUND

Air compressors are devices that are used to inflate inflatable objects (e.g., tires, floatation devices, etc.). Some air compressors include inflation settings (e.g., inflation rates) that are constant, or that are not based on inflation parameters (e.g., target air pressures) of inflatable objects. Such air compressors may present difficulties for inflating the inflatable objects. For example, an air compressor inflating an object having a low target air pressure may be susceptible to overinflating the object, or inflating the object to an inaccurate target air pressure. Additionally, an air compressor inflating an object having a high target air pressure may take an exceedingly long time to inflate the object.

Moreover, some air compressors include housings and air hoses that are connected in a way that renders stabilization of the air compressor during pumping operations difficult. For example, the housing may include a rough or uneven surface, or the air hose may be secured to the housing in a way that is awkward or burdensome. It may be advantageous for an air compressor to include inflation settings that are adjustable based on inflation parameters of the object it is inflating. Furthermore, it may be advantageous to provide an air compressor that is easily stabilized while the air compressor is inflating the inflatable object, and conveniently stores an air hose.

SUMMARY

Systems and methods are provided for a portable air compressor comprising an electric battery, an electric motor, a piston, and an air hose. The electric motor is powered by the electric battery. The piston is coupled to and driven by the electric motor. The piston is configured to compress air within a piston cylinder. The air hose has a first end attachable to an air outlet of the piston cylinder and a second end attachable to an inflatable object. The portable air pump is configured to inflate the inflatable object to a target air pressure. When the target air pressure is below a predetermined pressure threshold, the portable air pump inflates the inflatable object at a first inflation rate. When the target air pressure is above the predetermined pressure threshold, the portable air pump inflates the inflatable object at a second inflation rate greater than the first inflation rate.

In another example, a portable air pump includes an electric battery, an electric motor, a piston, an air hose, and a housing. The electric motor is powered by the electric battery. The piston is coupled to and driven by the electric motor. The piston is configured to compress air within a piston cylinder. The air hose has a first end attachable to an air outlet of the piston cylinder and a second end attachable to an inflatable object. The housing surrounds the electric motor and the electric battery. The housing has one or more flat sides and an air hose channel within the one or more flat sides. The air hose channel is configured to secure the air hose.

In another example, a method of inflating an inflatable object includes attaching an air hose of a portable air pump to the inflatable object. The method further includes selecting a target air pressure of the inflatable object. Based on a determination that the target air pressure is below a predetermined pressure threshold, the inflatable object is inflated at a first inflation rate. Based on a determination that the target air pressure is above the predetermined pressure threshold, the inflatable object is inflated at a second inflation rate greater than the first inflation rate.

BRIEF DESCRIPTION OF THE DRAWINGS

The following detailed description will be better understood when read in conjunction with the appended drawings. For the purpose of illustration, there is shown in the drawings certain embodiments of the present disclosure. It should be understood, however, that the invention is not limited to the precise arrangements and instrumentalities shown. The accompanying drawings, which are incorporated in and constitute a part of this specification, illustrate an implementation of systems and apparatuses consistent with the present invention and, together with the description, serve to explain advantages and principles consistent with the invention.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

It is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity and are not intended to limit the scope of the invention or the appended claims. Further, it should be understood that any one of the features can be used separately or in combination with other features. Other systems, methods, features, and advantages of the invention will be or become apparent to one with skill in the art upon examination of the detailed description. It is intended that all such additional systems, methods, features, and advantages be included within this description, be within the scope of the present invention, and be protected by the accompanying claims.

Portable air pumps and inflator systems may be used to inflate inflatable objects such as tires, balls used in sports, and rafts. As described above, some air compressors may present difficulties for inflating the inflatable objects, such as overinflating objects, inflating objects to inaccurate target air pressures, and taking longer than desired to inflate an inflatable object. Moreover, some air compressors include housings that are difficult to stabilize during an operation of the air compressor, or include air hoses that are inconveniently or awkwardly secured to the air compressor. Embodiments disclosed herein include systems and methods for inflating an inflatable object using inflation settings that are tailored to parameters of the inflatable object, mitigating or eliminating the difficulties of inflating the inflatable objects. Furthermore, embodiments disclosed herein include systems and methods that conveniently and discretely secure an air hose to the air compressor, and that provide a stable base during operation of an air compressor.

Figure 1A:
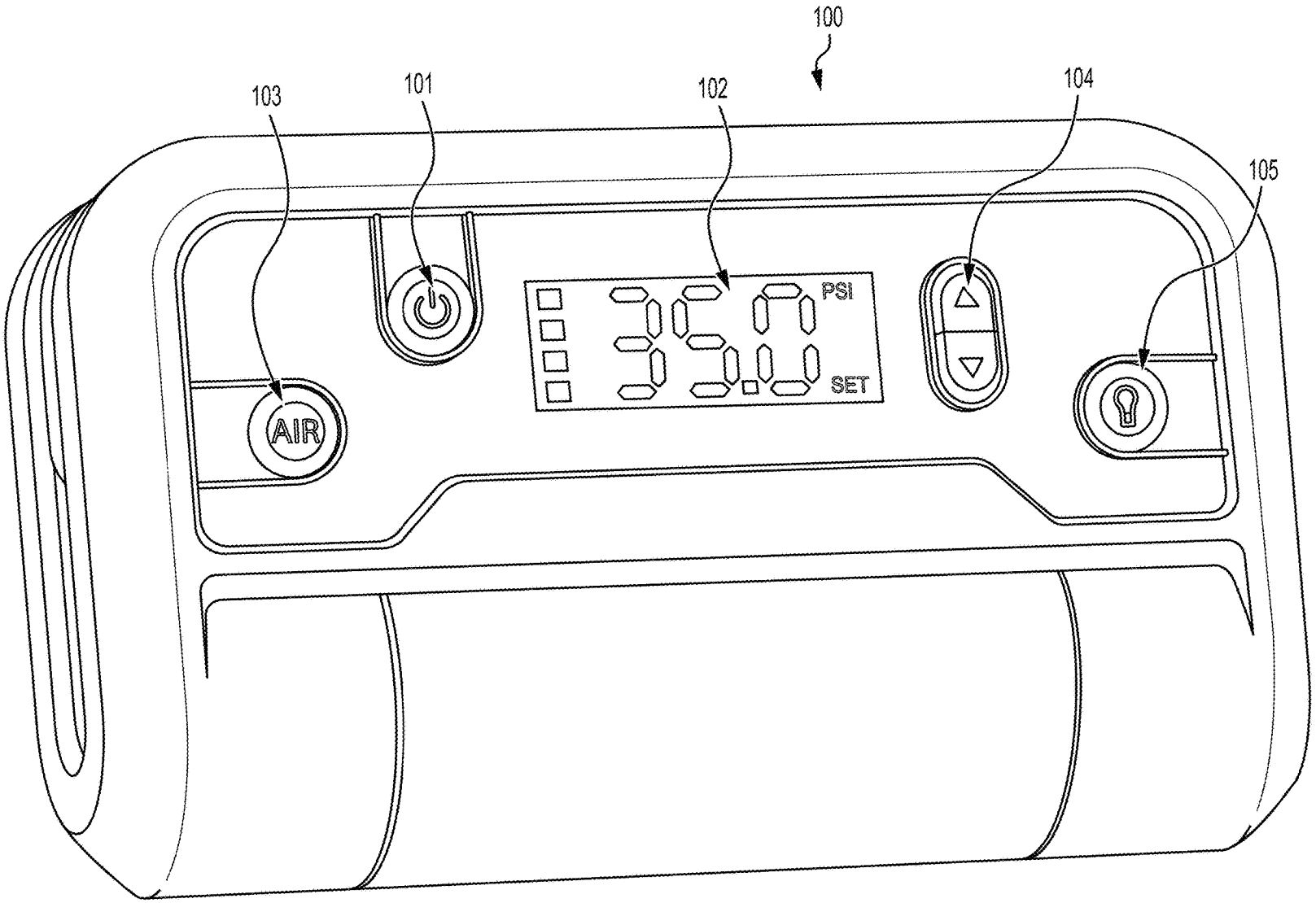
FIG. 1A depicts a front view of a portable air compressor, in accordance with some embodiments.

FIG. 1A depicts a front view of a portable air compressor, in accordance with some embodiments. The portable air compressor 100 may include a user interface having a power button 101. The power button 101 may be configured to toggle power of the portable air compressor 100 off and on. The user interface may further include an inflator power button 103 that is configured to toggle an inflator system of the portable air compressor 100 on and off. For example, a push of the inflator power button 103 while the inflator system is in an idle state (e.g., not transferring air to an inflatable object) may cause the inflator system to initiate an active state (e.g., transferring air from the portable air compressor 100 to the inflatable object). Furthermore, a push of the inflator power button 103 while the inflator system is in the active state may cause the inflator system to initiate the idle state.

The user interface may further include a display 102. The display 102 may be configured to display a target air pressure of an inflatable object. The target air pressure may represent, for example, an air pressure to which a user desires to inflate the inflatable object. The portable air compressor 100 may include a maximum target pressure (e.g., 150 pounds per square inch (PSI)) and a minimum target pressure (e.g., 3 PSI). The display 102 may be further configured to display a detected air pressure of the inflatable object. The display 102 may be configured to display the detected air pressure when the detected air pressure is greater than a predetermined pressure threshold (e.g., 3 PSI), and to display the target air pressure (e.g., a previous "SET" pressure) when the detected air pressure is less than the predetermined pressure threshold. In some examples, the display 102 may toggle between displaying the target air pressure and the detected air pressure.

The display 102 may further include units (e.g., PSI, pascals (Pa), etc.) in which the target air pressure and the detected air pressure are displayed. The display may further include one or more selection buttons 104. The selection buttons 104 may be "up" and "down" buttons that are configured to control (e.g., set) the target air pressure desired by the user. For example, subsequent presses of the "up" and "down" buttons may change the target pressure by a predetermined pressure amount (e.g., 0.5 PSI, 0.1 PSI). Moreover, the selection buttons 104 may be configured to toggle between the units displayed on the display 102. For example, the user may simultaneously hold down the "up" and "down" buttons for a predetermined time period (e.g., 3 seconds), after which the currently set unit will flash. The user can then switch between units by pressing the "up" and "down" buttons. After the user does not touch the buttons for the predetermined time period, the currently highlighted pressure unit may be selected. The portable air compressor 100 may store a previously set target pressure and pressure units in memory, and use and display the previous settings when the portable air compressor 100 is turned on.

In some examples, the user may select the "up" or "down" button continuously for greater than a predetermined time period (e.g., 0.5 seconds), at which point the set pressure may increase or decrease rapidly until the button is released. For example, when the user continuously holds the "up" button a transition from the minimum target pressure to the maximum target pressure may occur in another predetermined time period (e.g., 15 seconds). The rapid increase or decrease of the target pressure may occur only when the portable air compressor 100 is not running (e.g., not inflating an inflatable object). When the portable air compressor 100 is running, the target pressure may only change by the predetermined pressure amount with subsequent "up" or "down" button presses as described above.

The portable air compressor may be further configured to operate in a manual function (e.g., "manual mode"). The user may set the portable air compressor 100 into manual mode, for example, but selecting a predetermined pressure (e.g., 0.0 PSI). During an operation in manual mode, the portable air compressor 100 may eject pressurized air when the inflator power button 103 is pressed, and may continue to operate until a subsequent press of the inflator power button 103, or until the detected pressure of the inflatable object reaches the maximum target pressure. In manual mode, all safety protection features of the portable air compressor 100 may be enabled. The portable air compressor 100 may shut off if an error condition occurs.

The portable air compressor 100 may be configured to "rollover" from the minimum target pressure to the maximum target pressure, and vice versa. For example, if the display 102 displays the minimum target pressure and a user presses the "down" button, the display may display 0.0 PSI (at which point the user may select manual mode, as described above). A subsequent press of the "down" button may cause the display 102 to display the maximum target pressure. Similarly, a press of the "up" button when the display 102 displays the maximum target pressure may cause the display 102 to display 0.0 PSI, and a subsequent press of the "up" button may cause the display 102 to display the minimum target pressure.

The display 102 may further include a power indicator that is used to display a power level of the portable air compressor 100. For example, the power indicator may include a plurality of light sources, which can include different colors of light sources. A number of the plurality of light sources turned on may correspond to the power level of the portable air compressor 100. For example, a greater number of light sources turned on may correspond to a higher power level, while a fewer number of light sources turned on may correspond to a lower power level. The user interface may further include a flashlight button 105, which may be configured to toggle power of a flashlight 501 (FIG. 5A) on and off. For example, the flashlight 501 may be turned on by a press of the flashlight button 105 for a predetermined time (e.g., 3 seconds). The flashlight 501 may then turn off when based on a subsequent press of the flashlight button 105 for the predetermined time, a passing of a predetermined time period with no user interaction (e.g., 2 hours), or the occurrence of an error within the portable air compressor 100. Moreover, the flashlight button 105 may be configured to alter a brightness level of the flashlight 501. For example, subsequent pushes of the flashlight button 105 may increase the brightness level of the flashlight 501 in predefined increments, until a maximum brightness is reached, at which point a subsequent press of the flashlight button 105 may turn off power to the flashlight 501.

The portable air compressor 100 may be configured to inflate objects having different target pressures at different inflation rates. For example, a user may select a first target pressure (e.g., 8 PSI) for inflating a relatively low-pressure object (e.g., basketball). This first target pressure may be below a predetermined pressure threshold (e.g., 20 PSI). Based on the selection of this first target pressure that is below the predetermined pressure threshold, the portable air compressor 100 may inflate the low-pressure object at a first inflation rate. The first inflation rate may be a lower inflation rate than that used to inflate objects having a target pressure above the predetermined pressure threshold, as described below. The first inflation rate can thus ensure that the low-pressure object is not over-inflated and is inflated to an accurate pressure (e.g., a pressure substantially similar to the target pressure).

In another example, the user may select a second target pressure (e.g., 35 PSI) for inflating a relatively high-pressure object (e.g., a vehicle tire). Based on the selection of this second target pressure that is above the predetermined pressure threshold, the portable air compressor 100 may inflate the high-pressure object at a second inflation rate. The second inflation rate may be greater than the first inflation rate. The second inflation rate can ensure that the inflatable object having a target pressure above the predetermined pressure threshold is inflated timely.

Figure 1B:
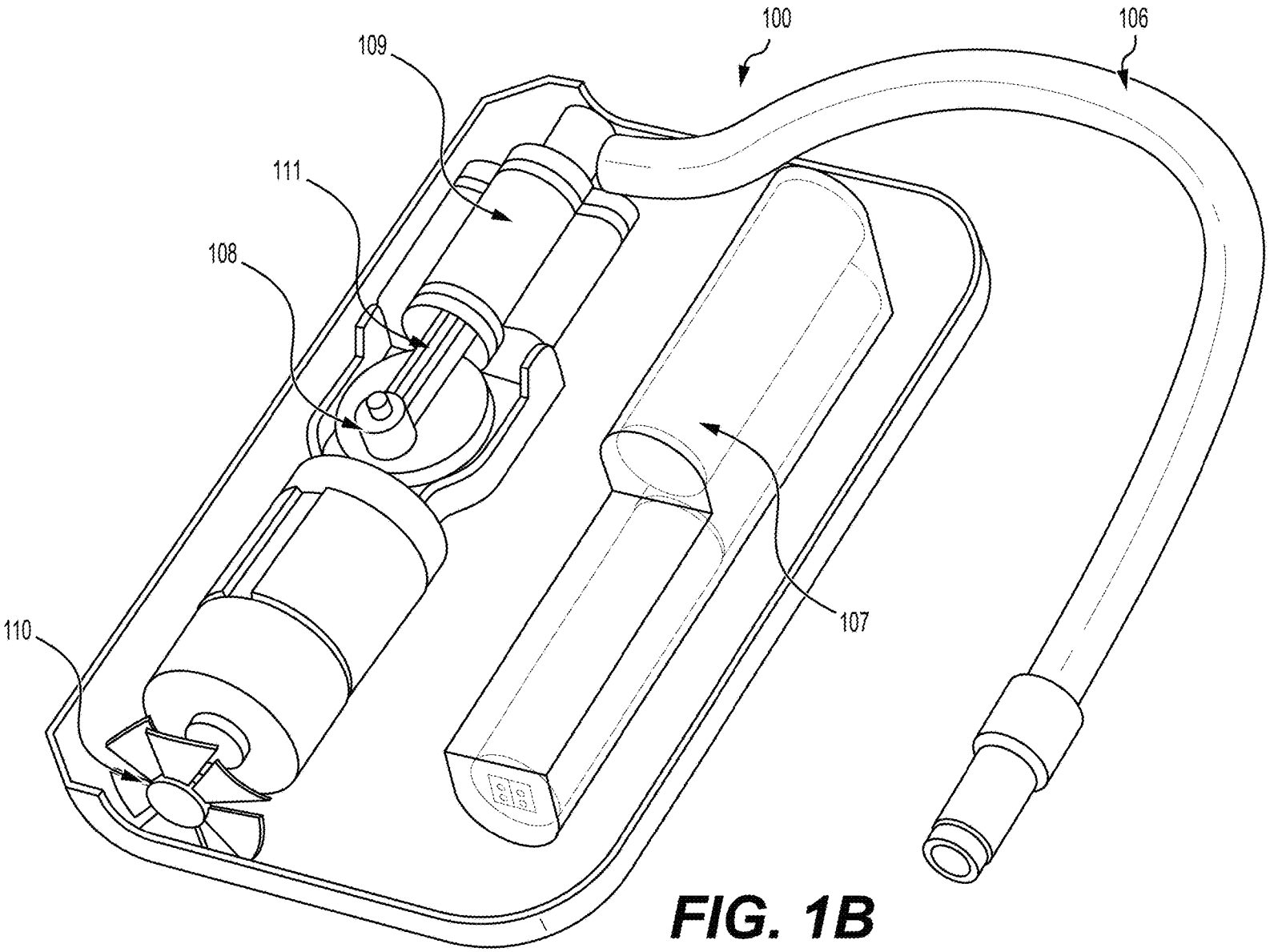
FIG. 1B depicts a cutaway view of a portable air compressor, in accordance with some embodiments.

In some examples, the portable air compressor 100 may be configured to dynamically transition between the first inflation rate and the second inflation rate. For example, a user may initially select a target pressure of an inflatable object that is above the predetermined pressure threshold. The portable air compressor 100 may thus begin inflating the inflatable object at the second inflation rate. The user may subsequently change the target pressure to a value that is below the predetermined pressure threshold. Based on the change from the second target pressure to the first target pressure, the portable air compressor 100 may transition from inflating the inflatable object at the second inflation rate to inflating the inflatable object at the first inflation rate. This transition may occur, for example, during operation of the portable air compressor 100 (i.e., while the portable air compressor is inflating the inflatable object). The portable air compressor 100 may include a processor or a controller (not shown) that is coupled to the user interface and an electric motor 108 (FIG. 1B). The processor or controller may be configured to perform the functions described above (e.g., inflating inflatable objects at different inflation rates based on the inflation parameters of the inflatable object). The processor or controller may be further configured to perform other functions of the portable air compressor 100, such as the charging functions described with respect to FIG. 6.

FIG. 1B depicts a cutaway view of a portable air compressor, in accordance with some embodiments. The portable air compressor 100 includes a battery 107 (e.g., a Lithium-ion battery) and an electric motor 108 powered by the battery 107. The power button 101 depicted in FIG. 1 may be used to toggle on and off power from the battery 107 to the electric motor 108. A fan 110 may be positioned within the portable air compressor 100 near the electric motor 108. The fan 110 may cause airflow within and out of the portable air compressor 100 to cool the battery 107 and the motor 108 and thus prevent overheating of the portable air compressor 100. The portable air compressor 100 further includes a piston cylinder 109. The electric motor 108 is connected to and drives a piston rod 111, which is connected to a piston head (not shown) within the piston cylinder 109. The piston head compresses air within the piston cylinder 109 when the piston rod 111 is driven by the motor 108, forcing the air out of the piston cylinder 109 and into an air hose 106. The air hose 106 includes a first end attached to the piston cylinder 109 and a second end that is attachable to an inflatable object, such as a vehicle tire (not shown). The portable air compressor 100 may further include a pressure sensor (not shown) that is configured to detect the pressure of the inflatable object.

Figure 2:
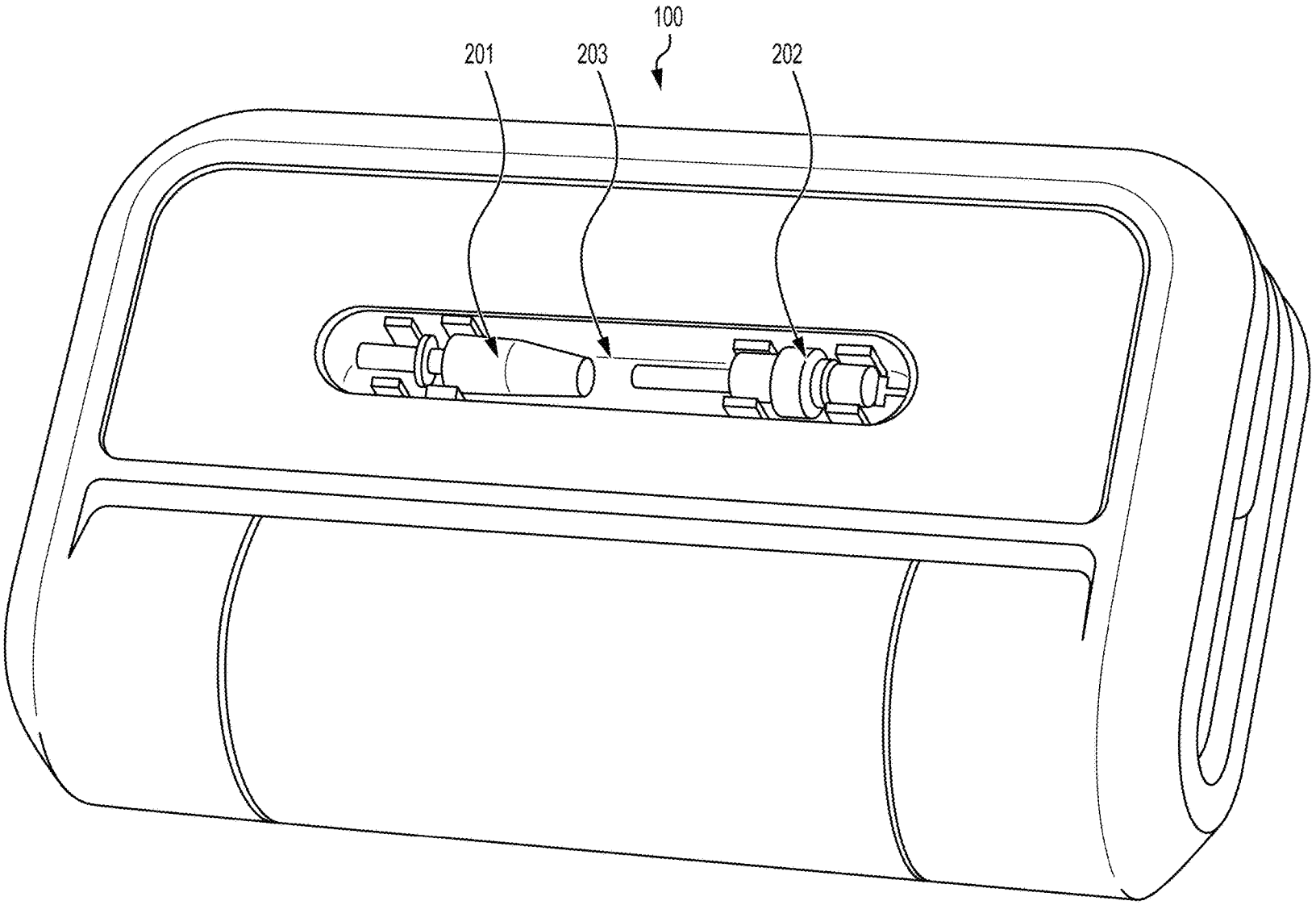
FIG. 2 depicts a rear view of a portable air compressor, in accordance with some embodiments.

FIG. 2 depicts a rear view of a portable air compressor, in accordance with some embodiments. As shown in FIG. 2, the portable air compressor 100 may include a recess 203 within its rear side. One or more air hose attachments 201, 202 may be secured within the recess 203. For example, the recess 203 may secure a first air hose attachment 201 (e.g., inflatable adapter) and a second air hose attachment 202 (e.g., Presta adapter, needle adapter). In some examples, the recess 203 secures additional air hose attachments (e.g., quick-disconnect adapter). The different attachments 201, 202 may be selectively attached to the air hose 106 depending on the inflatable object that the portable air compressor 100 is being used to inflate. For example, the first air hose attachment 201 may be attached to the air hose 106 when inflating a raft, while the second air hose attachment 202 may be attached to the air hose 106 when inflating a tire. The recess 203 may include one or more protrusions to secure the air hose attachments 201, 202.

Figure 3:
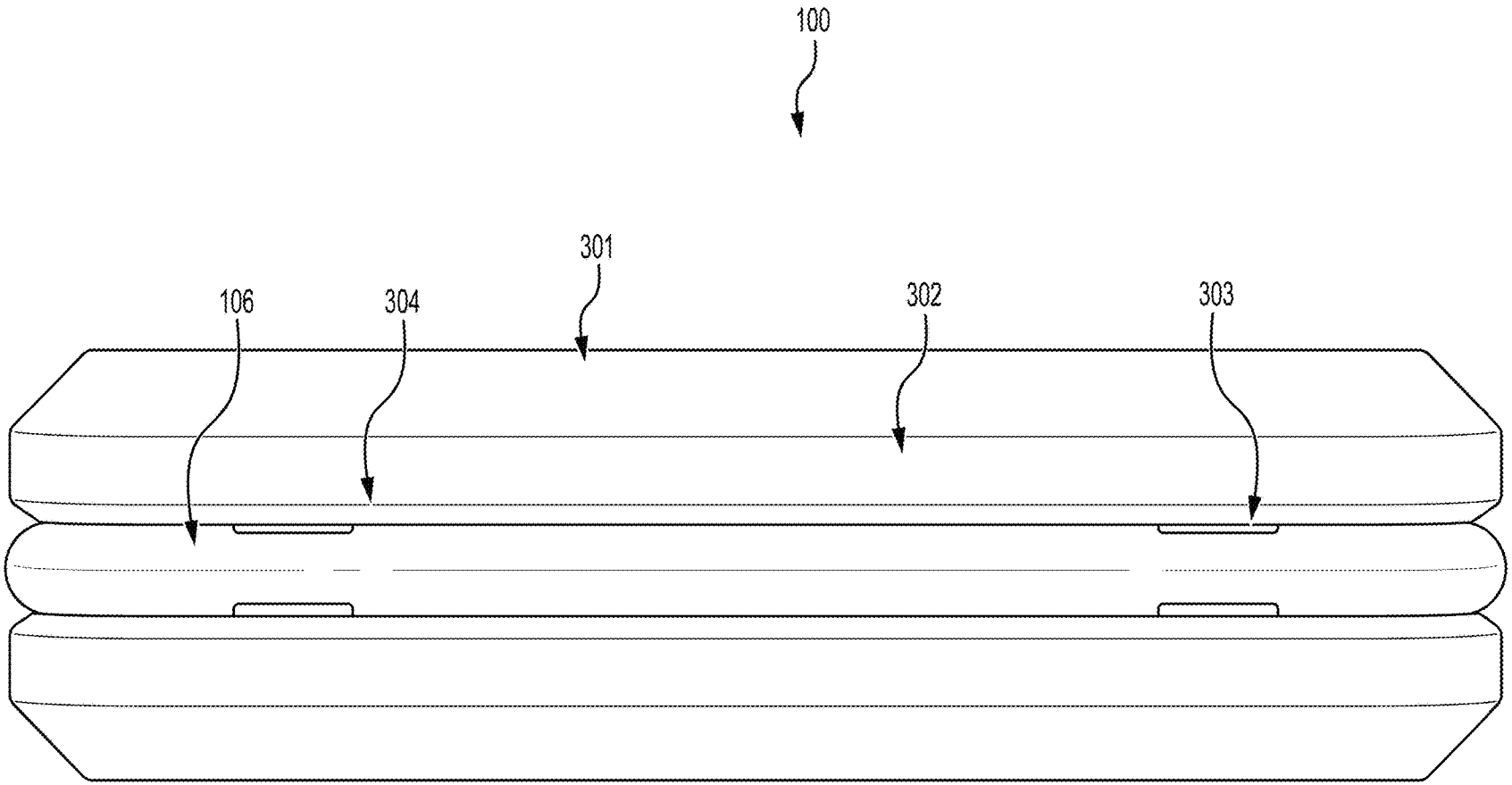
FIG. 3 depicts a top view of a portable air compressor, in accordance with some embodiments.

FIG. 3 depicts a top view of a portable air compressor, in accordance with some embodiments. The portable air compressor 100 includes a channel 304 into which the air hose 106 can be secured. The channel 304 may surround the portable air compressor on one or more sides (e.g., a top side, a right side, and a left side). The sides of the portable air compressor 100 may include edges 302 that are substantially flat. The portable air compressor may thus be able to stand upright on the edges 302 during storage and operation. The portable air compressor 100 may further include one or more tabs 303 connected to either side of the channel 304. The tabs 303 may assist in securing the air hose 106 within the channel 304 during storage. The tabs 303 may include a width sufficient to reliably secure the air hose 106 within the channel 304, but small enough to allow easy removal of the air hose 106 from the channel. As shown in FIG. 3, an outer edge of the air hose 106 is substantially collinear with the edges 302 of the portable air compressor 100. This arrangement may allow the portable air compressor 100 to stand upright and to be stored without interference from the air hose 106.

Figure 4:
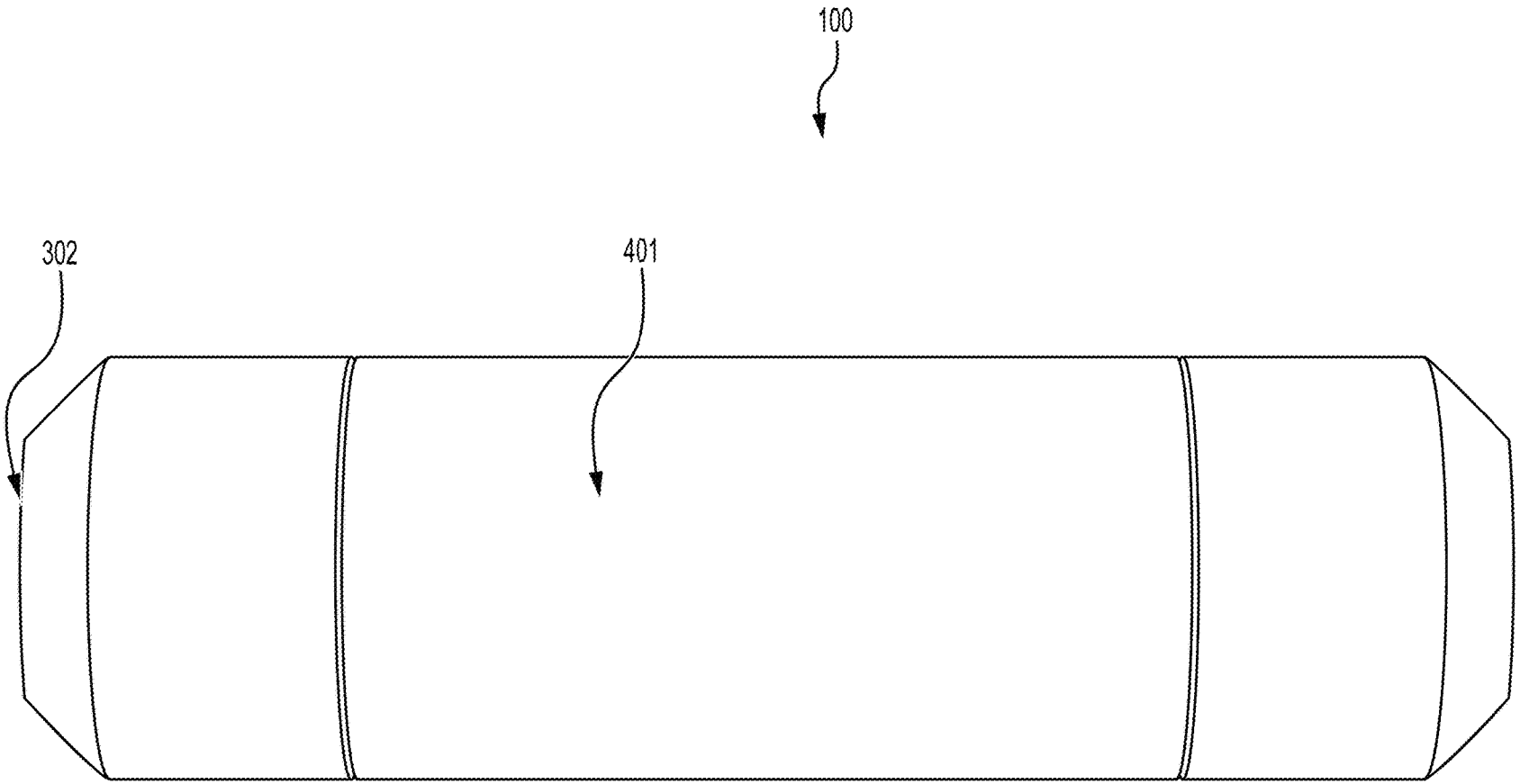
FIG. 4 depicts a bottom view of a portable air compressor, in accordance with some embodiments.

FIG. 4 depicts a bottom view of a portable air compressor, in accordance with some embodiments. As shown in FIG. 4, the bottom 401 of the portable air compressor may be rounded. The rounded bottom 401 may allow for a user to easily and comfortably hold the portable air compressor 100 at the bottom 401. In some examples, the bottom 401 of the portable air compressor 100 is a shape other than rounded (e.g., flat).

Figure 5B:
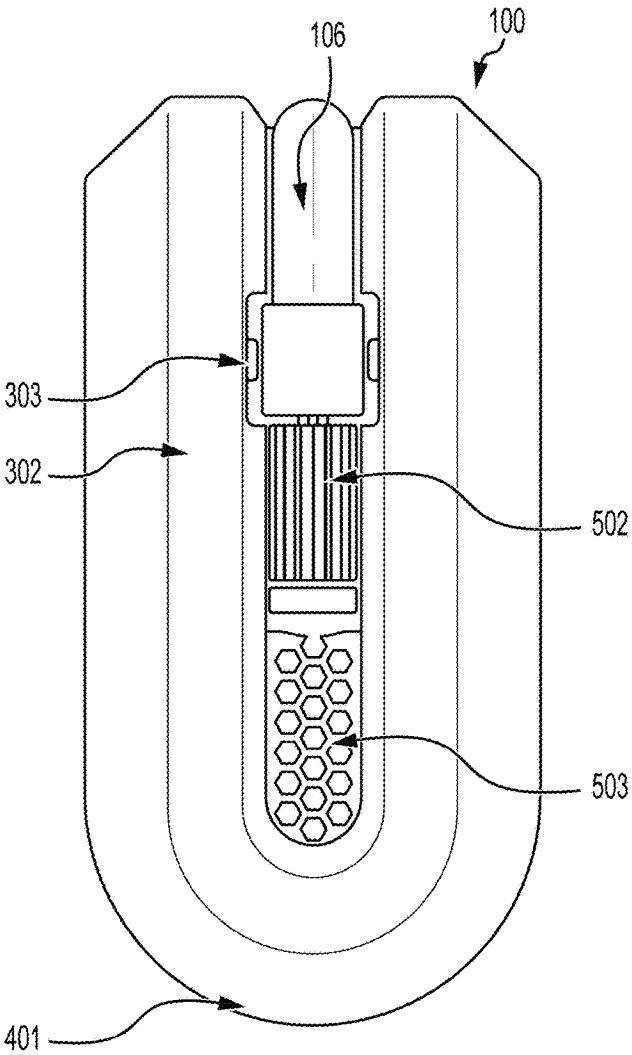
FIG. 5B depicts a second side view of a portable air compressor, in accordance with some embodiments.
Figure 5A:
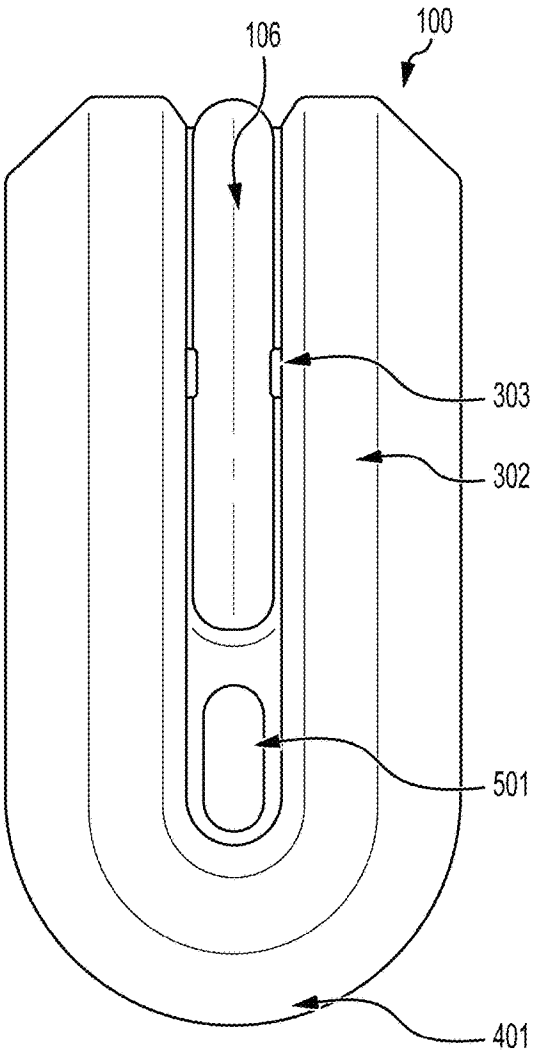
FIG. 5A depicts a first side view of a portable air compressor, in accordance with some embodiments.

FIG. 5A depicts a first side view of a portable air compressor, in accordance with some embodiments. As shown in FIG. 5A, the portable air compressor 100 may include the flashlight 501 described above with respect to FIG. 1. The flashlight 501 may be adjacent to the first end of the air hose 106. One or more of the tabs 303 may also be located on the first side of the portable air compressor 100 to secure the air hose 106 within the channel 304 (FIG. 3). The flat edges 302 may extend along the first side of the portable air compressor 100.

FIG. 5B depicts a second side view of a portable air compressor, in accordance with some embodiments. The portable air compressor 100 may include an air vent 503. The air vent 503 may be positioned next to the fan 110 (FIG. 1B), which can allow air displaced by the fan 110 to move through the air vent. The air vent 503 may thus facilitate the dissipation of heat generated by internal components of the portable air compressor 100, such as the battery 107 and the motor 108. As shown in FIG. 5B, the second end of the air hose 106 may be secured within the channel 304 (FIG. 3) at the second side of the portable air compressor 100. For example, one or more of the tabs 303 may be positioned on the second side of the portable air compressor 100 to secure the air hose 106. A nozzle 502 may be attached to the second end of the air hose 106. The one or more air hose attachments 201, 202 may be configured to attach to the air hose 106 at the nozzle 502. Furthermore, the edges 302 may extend along the second side of the portable air compressor 100.

Figure 6:
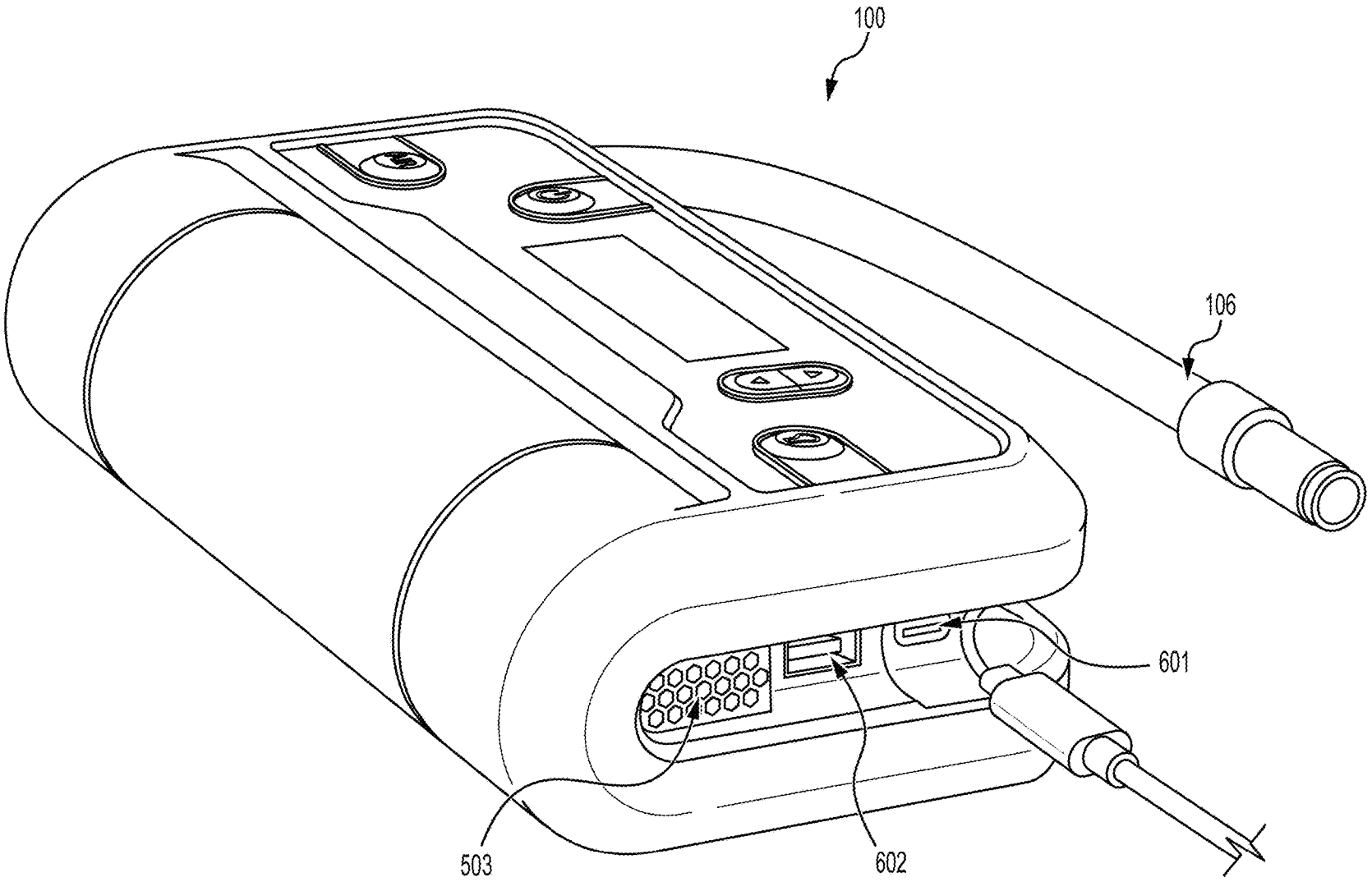
FIG. 6 depicts an isometric view of a portable air compressor, in accordance with some embodiments.

FIG. 6 depicts an isometric view of a portable air compressor, in accordance with some embodiments. As shown in FIG. 6, the portable air compressor 100 may include a charging port 601. The charging port 601 may be, for example, a USB-C charging port. The charging port 601 may be used to charge the portable air compressor 100 (e.g., the battery 107) and may also be utilized to power external devices. The portable air compressor 100 may further include an output port 602. The output port 602 may be a USB-A port and may be utilized to power external devices. The charging port 601 and the output port 602 may be used simultaneously. Furthermore, the portable air compressor 100 may be utilized while it is being charged (e.g., via the charging port 601) or while the output port 602 is being used to charge an external device. As shown in FIG. 6, the charging port 601 and the output port 602 may be positioned within the channel 304 of the portable air compressor 100 and may be exposed when the air hose 106 is removed from the channel 304.

Figure 7:
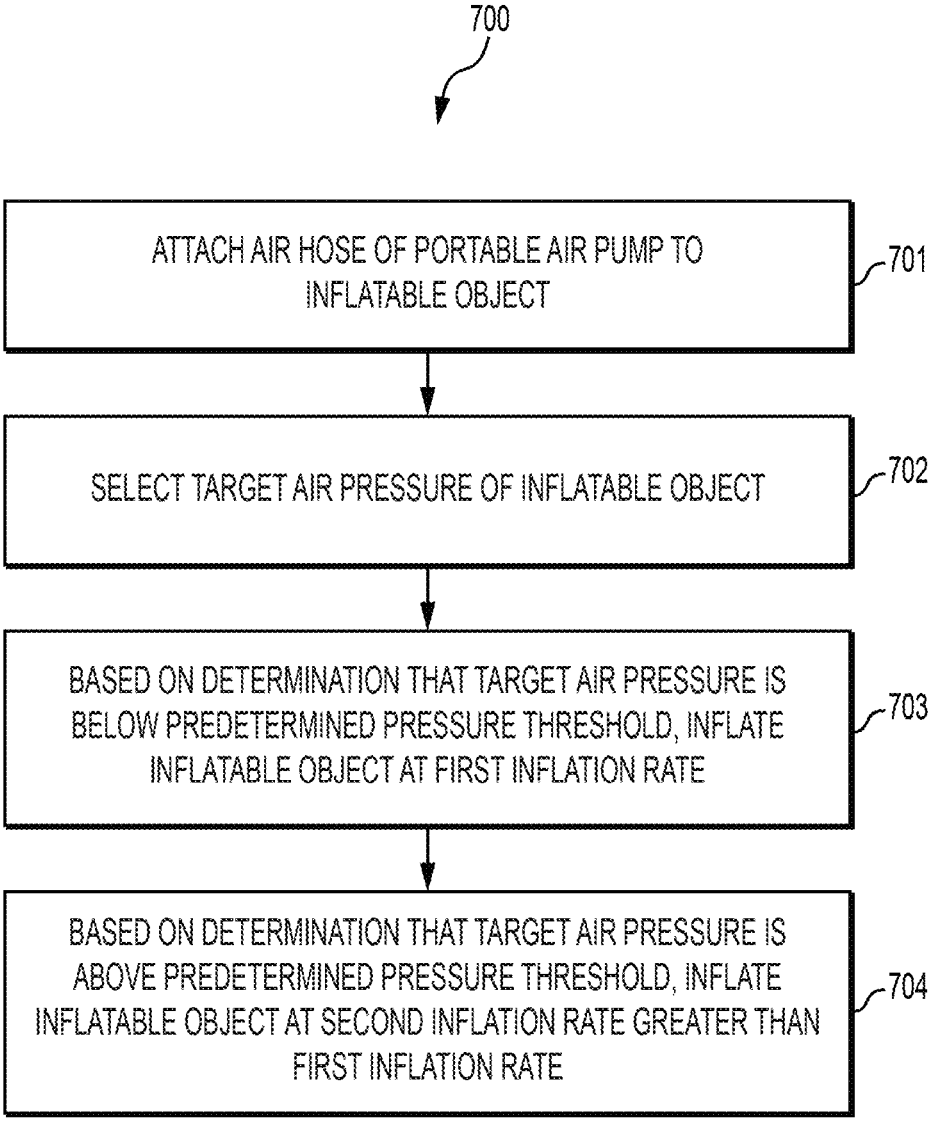
FIG. 7 depicts a method of inflating an inflatable object, in accordance with some embodiments.

FIG. 7 depicts a method of inflating an inflatable object, in accordance with some embodiments. The method 700 includes a first step 701 of attaching an air hose of a portable air pump to the inflatable object. At 702, a target air pressure of the inflatable object is selected. At 703, the inflatable object is inflated at a first inflation rate based on a determination that the target air pressure is below a predetermined pressure threshold. At 704, based on a determination that the target air pressure is above the predetermined pressure threshold, the inflatable object is inflated at a second inflation rate that is greater than the first inflation rate.

It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

What is claimed is:

1. A portable air compressor comprising:

an electric battery;

an electric motor powered by the electric battery;

a piston coupled to and driven by the electric motor, the piston configured to compress air within a piston cylinder; and an air hose having a first end attachable to an air outlet of the piston cylinder and a second end attachable to an inflatable object, the portable air compressor configured to inflate the inflatable object to a target air pressure;

wherein the portable air compressor is configured to determine when the target air pressure is below a predetermined pressure threshold, and based on a determination that the target air pressure is below the predetermined pressure threshold, inflate the inflatable object at a first inflation rate; and wherein the portable air compressor is further configured to determine when the target air pressure is above the predetermined pressure threshold, and based on a determination that the target air pressure is above the predetermined pressure threshold, inflate the inflatable object at a second inflation rate greater than the first inflation rate.

2. The portable air compressor of claim 1, the portable air compressor further configured to continuously inflate the inflatable object based on an interaction of a user.

3. The portable air compressor of claim 1, wherein the portable air compressor is further configured to change the target air pressure during an operation of the portable air compressor and to transition between the first inflation rate and the second inflation rate based on the change in the target air pressure.

4. The portable air compressor of claim 1, further comprising a user interface configured to receive the target air pressure from a user.

5. The portable air compressor of claim 4, wherein the user interface includes a display configured to display the target air pressure.

6. The portable air compressor of claim 1, further comprising a recess configured to secure one or more attachments, the one or more attachments attachable to the second end of the air hose.

7. The portable air compressor of claim 1, further comprising:

a housing surrounding the electric motor and the electric battery, the housing having one or more flat sides and an air hose channel within the one or more flat sides, the air hose channel configured to secure the air hose, wherein an outer edge of the air hose, when secured in the air hose channel, is substantially collinear with edges of the one or more flat sides to permit the housing to stand upright without interference from the air hose.

8. The portable air compressor of claim 7, wherein the air hose is contained within an outer perimeter of the housing when the air hose is secured within the air hose channel.

9. The portable air compressor of claim 7, further comprising an air vent disposed within the air hose channel.

10. The portable air compressor of claim 7, further comprising an external power port configured to deliver electrical power to an external electronic device.

* * * * *